US008063844B1

(12) United States Patent
Pease

(10) Patent No.: US 8,063,844 B1
(45) Date of Patent: Nov. 22, 2011

(54) OMNIDIRECTIONAL ANTENNA SYSTEM

(75) Inventor: Brian L. Pease, Milton, VT (US)

(73) Assignee: Kutta Technologies, Inc., Phoenix, AZ (US)

( * ) Notice: Subject to any disclaimer, the term of this patent is extended or adjusted under 35 U.S.C. 154(b) by 807 days.

(21) Appl. No.: 11/970,142

(22) Filed: Jan. 7, 2008

Related U.S. Application Data

(60) Provisional application No. 60/887,088, filed on Jan. 29, 2007.

(51) Int. Cl.
*H01Q 7/08* (2006.01)

(52) U.S. Cl. ..... 343/788

(58) Field of Classification Search ..... 343/788, 343/715, 702, 728
See application file for complete search history.

(56) References Cited

U.S. PATENT DOCUMENTS

| | | | | |
|---|---|---|---|---|
| 2,863,147 | A | 12/1958 | Berlin | |
| 3,440,542 | A | 4/1969 | Gautney | |
| 3,683,389 | A | 8/1972 | Hollis | |
| 3,721,989 | A | 3/1973 | Christensen | |
| 4,144,496 | A | 3/1979 | Cunningham et al. | |
| 4,155,091 | A * | 5/1979 | Vorie | 343/728 |
| 4,443,802 | A | 4/1984 | Mayes | |
| 5,256,971 | A * | 10/1993 | Boskamp | 324/318 |
| 5,426,439 | A | 6/1995 | Grossman | |
| 5,592,182 | A | 1/1997 | Yao et al. | |
| 6,194,980 | B1 * | 2/2001 | Thon | 333/109 |
| 6,414,647 | B1 | 7/2002 | Lee | |
| 6,810,353 | B2 | 10/2004 | Schiffbauer | |
| 7,079,081 | B2 | 7/2006 | Parsche et al. | |
| 7,154,445 | B2 | 12/2006 | Littlefield et al. | |
| 2006/0012535 | A1 | 1/2006 | McLean | |
| 2009/0284422 | A1 * | 11/2009 | Schlager et al. | 343/702 |

* cited by examiner

*Primary Examiner* — Huedung Mancuso
(74) *Attorney, Agent, or Firm* — Klemchuk Kubasta LLP; Shannon W. Bates

(57) ABSTRACT

An omnidirectional antenna system. Implementations may include an antenna having a wire loop and a single ferrite rod loop. The single ferrite rod loop may be oriented substantially parallel to a plane formed by the wire loop. The single ferrite rod loop may include a plurality of windings and a ferrite rod having a length and two ends. The two ends of the ferrite rod may be substantially centered relative to the wire loop. The plurality of windings may be distributed across a majority of the length of the ferrite rod.

9 Claims, 6 Drawing Sheets

OMNIDIRECTIONAL ANTENNA SYSTEM

CROSS REFERENCE TO RELATED APPLICATIONS

This document claims the benefit of the filing date of U.S. Provisional Patent Application 60/887,088, entitled "Omnidirectional Antenna" to Pease which was filed on Jan. 29, 2007, the disclosure of which is hereby incorporated herein by reference.

STATEMENT REGARDING FEDERALLY SPONSORED RESEARCH OR DEVELOPMENT

The U.S. Government has a paid-up license in implementations of systems and methods disclosed in this document and the right in limited circumstances to require the patent owner to license others on reasonable terms as provided for by the terms of contract No. WP7T-06-C-K203 awarded by the United States Army.

BACKGROUND

1. Technical Field

Aspects of this document relate generally to antennas and antenna systems.

2. Background Art

Conventionally, antenna designs utilized by various radio systems differ in structure depending upon many factors. Some of these include the frequency of the radio or microwave radiation, the rated power of the system, structural stability, and form factor requirements. Others are the location of installation (transmission tower vs. handheld receiving device), required use conditions (an actively rotating radar tower vs. a fixed position telecommunication microwave relay antenna), or the ability of the signal to handle obstacles ("line-of-sight" systems like microwave transmission systems vs. "non-line of sight" radios like those utilized in some wireless networks).

SUMMARY

Implementations of an omnidirectional antenna system may include an antenna having a wire loop and a single ferrite rod loop. The single ferrite rod loop may be oriented substantially parallel to a plane formed by the wire loop. The single ferrite rod loop may include a plurality of windings and a ferrite rod having a length and two ends. The two ends of the ferrite rod may be substantially centered relative to the wire loop. The plurality of windings may be distributed across a majority of the length of the ferrite rod.

Implementations of a omnidirectional antenna system may include one, all, or some of the following:

A hybrid network may be coupled to the antenna. The wire loop and the single ferrite rod loop may be substantially electrically isolated from each other through the hybrid network.

At least one resistor may be coupled to at least one of the wire loop and the ferrite rod loop.

The wire loop may be substantially circular or substantially square. The ferrite rod may have a substantially circular cross-section or a substantially rectangular cross-section.

A transmit amplifier may be coupled to the hybrid network.

At least one hook may be coupled to the antenna, the hook configured to couple to a wire or pipe.

Implementations of an omnidirectional antenna system may include only two decoupled loops substantially in the same plane driven 90 degrees out of phase by a hybrid network. The hybrid network may be configured to generate a substantially omniazimuthal horizontal magnetic field pattern.

Implementations of an omnidirectional antenna system may include one, all, or some of the following:

The only two decoupled loops may be sharply tuned.

At least one resistor may be coupled to at least one of the only two decoupled loops and the at least one resistor may be configured to increase the bandwidth of the at least one of the only two decoupled loops.

The hybrid network may include a phase shifting circuit and a quadrature splitting/combining circuit. The phase shifting circuit and quadrature splitting/combining circuit may be configured to drive the only two decoupled loops 90 degrees out of phase and to generate a substantially omniazimuthal horizontal magnetic field pattern. The substantially omniazimuthal horizontal magnetic field pattern may rotate once per cycle.

The hybrid network may include a 50 ohm input.

Each of the only two decoupled loops may handle only half of the radio power input to the antenna system and the bandwidth of each of the only two decoupled loops may be substantially constant for any input impedance. The input impedance may remain substantially constant when either or both of the only two decoupled loops are severely detuned.

Implementations of an omnidirectional antenna system may utilize a method of radio frequency communication including receiving a first radio signal through an antenna having at least two loop elements, processing the first radio signal with a hybrid network, and converting an input signal from a radio into a second radio signal with the hybrid network. The method may further include driving the at least two loop elements of the antenna substantially 90 degrees out of phase by phase shifting and quadrature splitting/combining of the second radio signal through the hybrid network. The method may also include transmitting the second radio signal in a horizontal plane in a substantially omniazimuthal magnetic field through the antenna.

Implementations of a method of radio frequency communication may include one, all, or some of the following steps:

Increasing the bandwidth of the at least two loop elements through coupling a resistor with the at least two loop elements.

Transmitting the second radio signal and receiving the first radio signal may take place while rotating the at least two loop elements 360 degrees relative to the axis of a tunnel.

Receiving a first radio signal and transmitting the second radio signal in the horizontal plane may further include the step of extending the reception of the first radio signal and the transmission of the second radio signal through coupling the antenna to a wire or pipe in a tunnel through at least one hook coupled to the antenna.

Implementations of omnidirectional antenna systems may also include a method of constructing an omnidirectional antenna system including forming an antenna through coupling a wire loop with a single ferrite rod loop having a ferrite rod with two ends. The method may further include orienting the single ferrite rod loop substantially parallel to a plane formed by the wire loop, substantially centering the two ends of the single ferrite rod relative to the wire loop, and coupling the antenna with a hybrid network.

Implementations of a method of forming an omnidirectional antenna system may include one, all, or some of the following steps.

Increasing the bandwidth of the omnidirectional antenna system through coupling at least one resistor with at least one of the wire loop and the single ferrite rod loop.

Ensuring that an axis of the wire loop and an axis of the single ferrite rod loop are substantially orthogonal by adjusting the position of a single ferrite rod included in the single ferrite rod loop.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended omnidirectional antenna and/or assembly procedures for an omnidirectional antenna will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such antennas and implementing components, consistent with the intended operation.

Implementations of omnidirectional antennas may be useful for short range communications in tunnels, caves, and buildings where pipes and wires may not be available to aid in propagating radio signals. Implementations may also be useful in applications where communication through walls, between adjacent tunnels, around corners, between floors in a building, and between a tunnel and the surface are desired. Implementations may also enable long distance communication in mines and other tunnels that have continuous wires running along the tunnels. Implementations of omnidirectional antennas may operate in the Low Frequency (LF) or Medium Frequency (MF) portions of the radio frequency spectrum.

Structure

Figure 1:
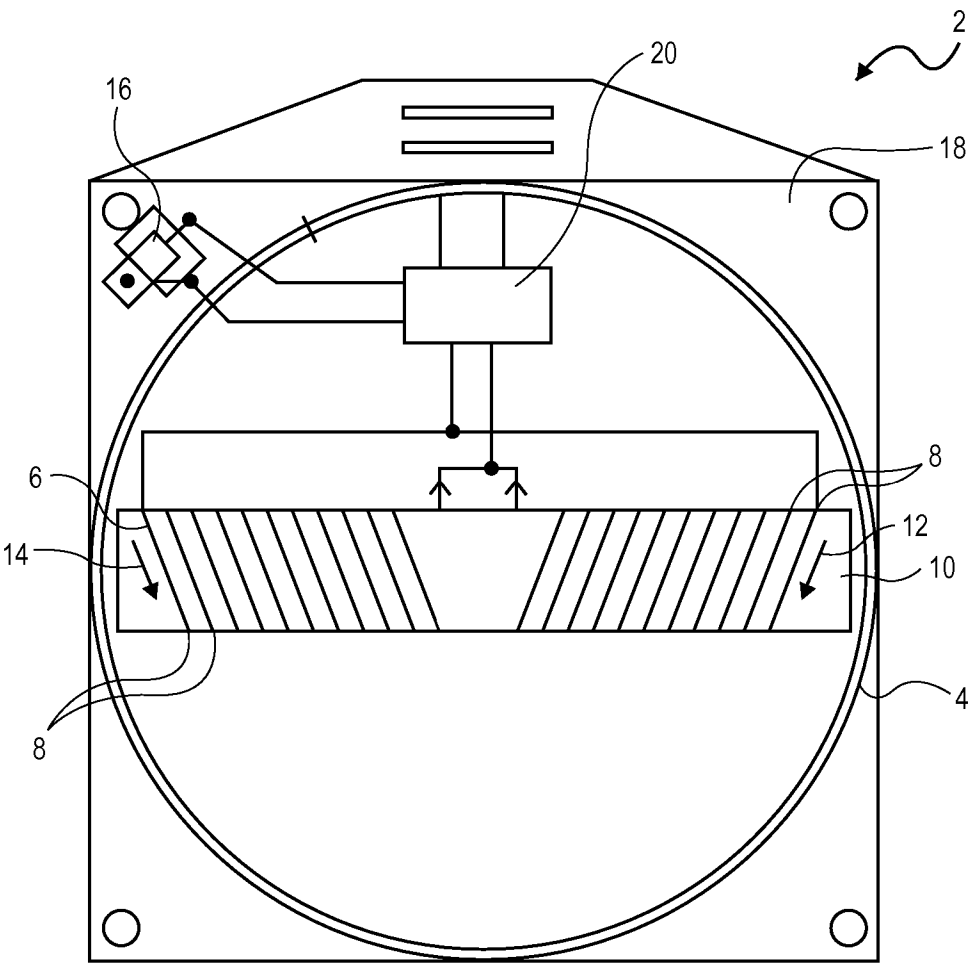
FIG. 1 is a front schematic view of an implementation of an elliptical omnidirectional antenna.

Referring to FIG. 1, an implementation of an omnidirectional antenna 2 (omnidirectional antenna system) is illustrated. The omnidirectional antenna 2 may include a wire loop 4 and a ferrite rod loop 6 oriented substantially parallel to a plane formed by the wire loop 4. In the particular implementation illustrated in FIG. 1, the ferrite rod loop 6 is substantially centered within the wire loop 4. In other particular implementations of an omnidirectional antenna 2, the ferrite rod loop 6 may be placed in any position parallel to the plane formed by the wire loop 4 (whether physically inside or outside the wire loop 4) provided the ends of a ferrite rod 10 included within the ferrite rod loop 6 are centered relative to the wire loop 4. An example of such an implementation can be seen in FIGS. 4 and 5. Deviations of the alignment of the ferrite rod loop 6 from a plane precisely parallel with the plane formed by the wire loop 4 may also occur in particular implementations as necessitated by concerns such as, by non-limiting example, signal tuning, magnetic field pattern, materials characteristics and the like.

The ferrite rod loop 6 may include a plurality of windings 8 around the ferrite rod 10 with its length and two ends, one section wound in a first direction indicated by arrow 12 and another section wound in a second direction indicated by arrow 14. As illustrated, the plurality of windings 8 may be distributed across the majority of the length of the ferrite rod 10. In other particular implementations, the plurality of windings 8 may include just one turn of wire around the ferrite rod 10. The plurality of windings 8 may also not be distributed across the majority of the length of the ferrite rod 10 in particular implementations; instead, the windings may be concentrated near the center of the ferrite rod 10. For the exemplary purposes of this disclosure, the number of windings in each section may include 27 turns, the ferrite rod may be 1 inch in diameter and 6 inches long, and the wire loop may be six inches in diameter. The ferrite rod may be "M" material from National Magnetics Group with a ui of 125. The plurality of windings 8 may be composed of 660/46 served Litz wire with a space between each turn as wide as #24 hookup wire.

The omnidirectional antenna 2 may also include a coaxial connector 16 coupled to a mounting board 18 to which the wire loop 4 and the ferrite rod loop 6 are secured with, by non-limiting example, tie wraps, glue, heat shrink fittings, solder, or any one of many other conventional attachment structures. The coaxial connector 16 may be coupled to the wire loop 4 and the ferrite rod loop 6 through a hybrid network 20. The hybrid network 20 electrically connects the wire loop 4 with the ferrite rod loop 6, allowing radio frequency signals from a radio connected to the coaxial connector 16 to pass into both the wire loop 4 and ferrite rod loop 6. For the exemplary purposes of this disclosure, the omnidirectional antenna 2 may be tuned to a 470 khz signal with a bandwidth of 12 khz independent of source or load impedance.

Figure 2:
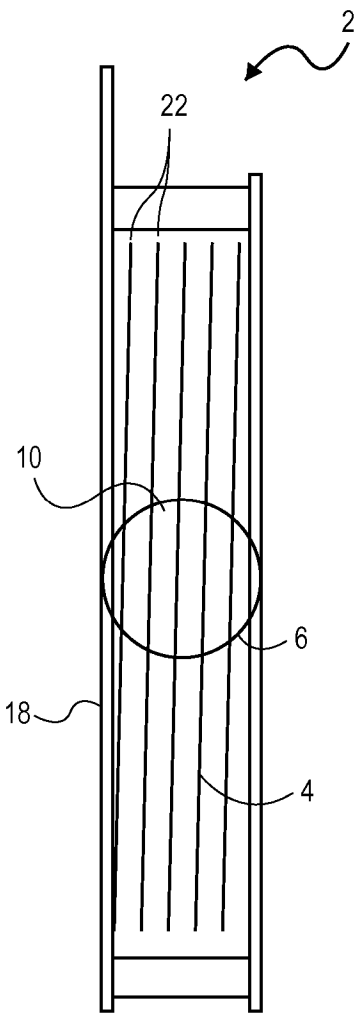
FIG. 2 is a side schematic view of the omnidirectional antenna implementation shown in FIG. 1.

Referring to FIG. 2, a side view of the implementation of an omnidirectional antenna 2 shown in FIG. 1 is illustrated. As illustrated, the wire loop 4 may form a plane and the ferrite rod loop 6 may be oriented substantially parallel to that plane. The wire loop 4 may have an axis extending through the center of the loop and the ferrite rod loop 6 may have an axis extending along the center of the ferrite rod. Implementations of omnidirectional antennas 2 will have these two axes substantially orthogonal. In particular implementations, the ferrite rod loop 6 may be substantially centered within the plane of the wire loop 4; in other implementations, the ferrite rod loop 6 may be oriented to either side of the plane or above or below the center of the wire loop 4, provided that the ends of the ferrite rod 10 are substantially centered relative to the wire loop 4. In some implementations, the ferrite rod loop 6 may be located outside the wire loop 4 substantially parallel to the plane of the wire loop 4 so long as the ends of the ferrite rod 10 are substantially centered relative to the wire loop 4.

The ferrite rod 10 utilized in the ferrite rod loop 6 may have a substantially circular cross section, a substantially square cross section, a rectangular cross section, or elliptical cross section. In addition, referring to FIGS. 1 and 2, the wire loop 4 may be substantially circular, substantially square, rectangular, elliptical, or formed in other regular or irregular closed shape. The wire loop 4 may also include a plurality of windings 22; for the exemplary purposes of this disclosure, 15 turns of wire may be used, the ferrite rod 10 may have a substantially circular cross section, and the wire loop 4 may be substantially circular. The wire used for the plurality of windings 22 may also be 660/46 Litz wire wound over a polyethylene sheet, which aids in forming the loop.

Figure 5:
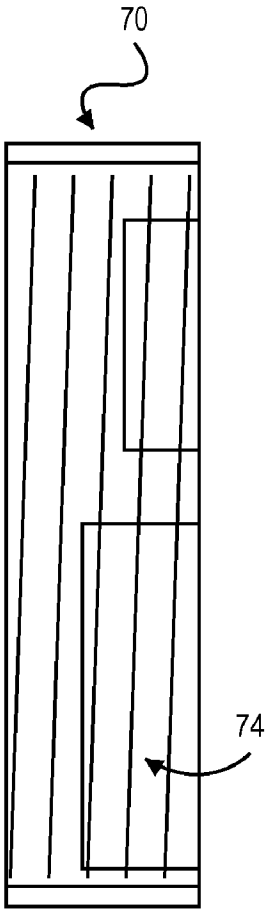
FIG. 5 is a side schematic view of the omnidirectional antenna implementation shown in FIG. 4.
Figure 4:
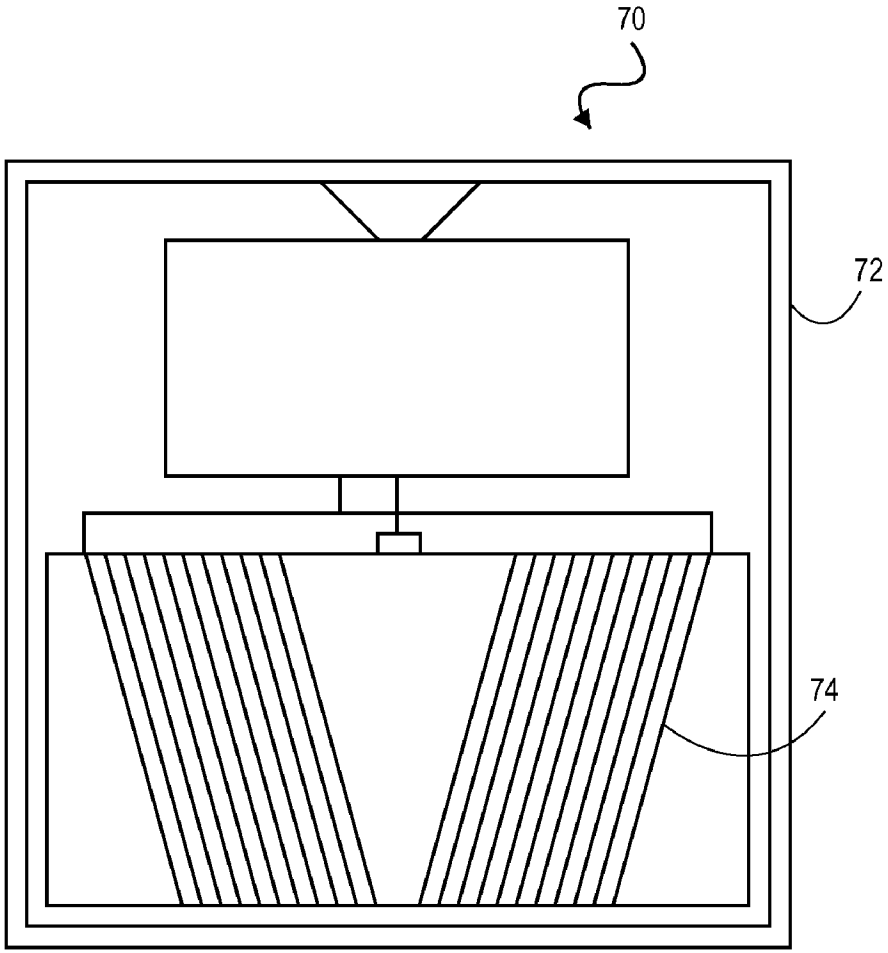
FIG. 4 is a front schematic view of an implementation schematic of another particular rectangular implementation of an omnidirectional antenna.

Referring to FIGS. 4 and 5, an implementation of an omnidirectional antenna 70 is illustrated. In the implementation illustrated in FIGS. 4 and 5, the wire loop 72 is substantially square and the ferrite rod loop 74 has a substantially rectangular cross section. The ferrite rod loop 74 is also located closer to one side of the wire loop 72, but the ends of the ferrite rod loop 74 are still centered with respect to the wire loop 72. In implementations of an omnidirectional antenna 70 that include substantially square wire loops 4, the ferrite rod loop 6 may be located anywhere within or outside the area enclosed by wire loop 4, provided that the ends of the ferrite rod loop 74 are still centered with respect to the wire loop 72.

Figure 3:
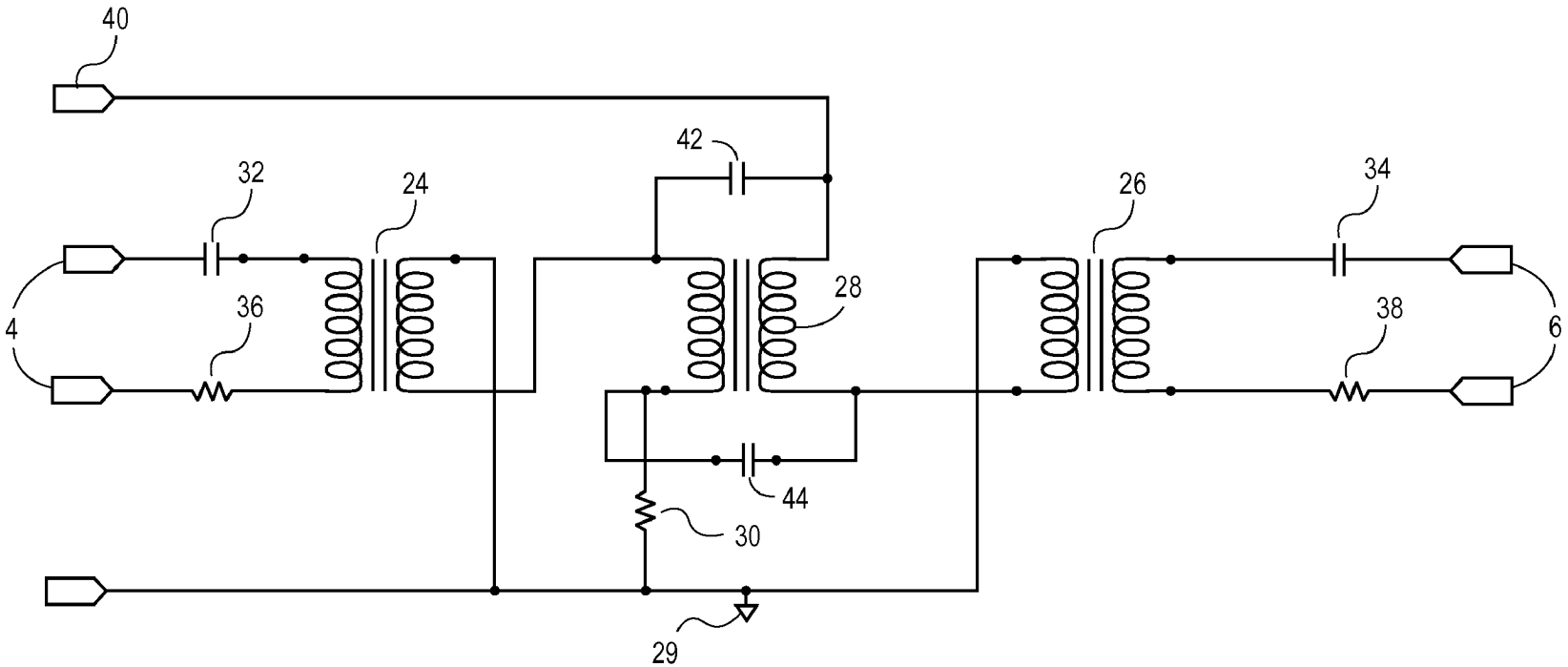
FIG. 3 is an electrical schematic of a particular implementation of a hybrid network.

Referring to FIG. 3 a particular implementation of a hybrid network 20 is illustrated. The hybrid network may include a first balun core matching transformer 24 coupled to the wire loop 4 and a second balun core matching transformer 26 coupled to the ferrite rod loop 6. The first and second balun core matching transformers 24, 26 step up the impedance of the wire loop 4 and ferrite rod loop 6, which are series-tuned loops, to the impedance of the input 40. The first and second balun core matching transformers 24, 26 may be coupled to a toroid 28. The toroid 28 may be coupled to ground 29 through a toroid resistor 30 and may include first and second toroid capacitors 42, 44 coupled across each end of the toroid 28, respectively. A first series-tuning capacitor assembly 32 may be coupled between the wire loop 4 and the first balun core matching transformer 24 and a second series-tuning capacitor assembly 34 may be coupled between the ferrite rod loop 6 and the second balun core matching transformer 26. The first and second series-tuning capacitor assemblies 32, 34 may each include at least one capacitor wired in parallel with a ceramic trimmer to permit manual adjustment of the capacitance of each tuning capacitor assembly. In particular implementations, first and second bandwidth resistors 36, 38 may be coupled between the first and second balun core matching transformers 24, 26, and the wire and ferrite rod loops 4, 6, respectively. An input 40 may be included that couples the coaxial connector 16 with the hybrid network 20. For the exemplary purposes of this disclosure, the input 40 may have an input impedance of 50 ohms. Table 1 details an exemplary set of design values for and sources of the electrical components comprising an implementation of a hybrid network 20.

TABLE 1

| Component | Value | Description/Source |
|---|---|---|
| 32, 34 | 11-110 pF | 500 VDC Erie #503 ceramic trimmer (Surplus Sales of Nebraska) |
| 32, 34 | ~1600-1900 pF | 600 VDC silver-mica capacitors |
| 24, 26 | 9:2 turns ratio | CWS/Bytemark balun core BN-202-43, 2T #20, 9T#24 enamel |

TABLE 1-continued

| Component | Value | Description/Source |
|---|---|---|
| 28 | 16.93 uH | ~15 bifilar turns of #24 enamel on CWS/Bytemark FT-50 A-61 toroid |
| 36, 38 | ~1.5-2.4 Ohms | 2 Watt 5% metal film resistor |
| 30 | 50 Ohms | 5 Watt metal oxide resistor, Mouser 286-51-RC |
| 42, 44 | 3300 pF | Silver-mica caps greater than 200 VDC |

While the hybrid network 20 connects the wire loop 4 and the ferrite rod loop 6, the actual design of the hybrid network 20 may produce several electrical effects of the antenna. The first of these is that the hybrid network 20 may permit the wire loop 4 and the ferrite rod loop 6 to be substantially electrically isolated with respect to each other. The second effect may be that the electrical currents in the wire loop 4 and the ferrite rod loop 6 may be maintained by the hybrid network substantially 90 degrees out of phase. The third electrical effect may be the enhancement of the bandwidth of the antenna by the coupling of at least one of the bandwidth resistors 36, 38 with at least one of the wire loop 4 or the ferrite rod loop 6. Without being bound by any theory, the resistor may serve to reduce the Q value of the loop, thereby increasing the available bandwidth. In implementations of omnidirectional antennas 2, the bandwidth may remain substantially constant regardless of the source or load impedance connected to input 40. Additionally, the hybrid network 20 may permit the transmit power of the antenna to be divided equally across both the wire loop 4 and the ferrite rod loop 6. Finally, implementations of the hybrid network 20 may maintain the impedance at input 40 substantially constant despite severe de-tuning of either or both of the wire loop 4 and the ferrite rod loop 6.

In particular implementations of an omnidirectional antenna 2, a transmit amplifier may be coupled to the hybrid network 20 to enable the amplification of the sending signal of a radio coupled to the omnidirectional antenna 2. In implementations of an omnidirectional antenna 2, during high efficiency operation, the output impedance of the transmit amplifier may approach zero ohms while not affecting the bandwidth of the wire loop 4 and ferrite rod loop 6. Particular implementations of an omnidirectional antenna 2 may include a receive preamplifier coupled to the hybrid network 20 to enable amplification of the received signal of a radio coupled to the omnidirectional antenna 2. The input impedance of the receive preamplifier may be 50 ohms without affecting the bandwidth of the wire loop 4 and ferrite rod loop 6.

Implementations of omnidirectional antennas 2, 70 may include at least one hook that can be used to hang the radio up on or adjacent to a wire, cable, or pipe in an underground tunnel, thereby effectively electrically coupling the wire loop 4 and/or the ferrite rod loop 6 with the wire, cable, or pipe and enabling the reception/transmission of radio frequency signals over long distances along a tunnel. Without being bound by any theory, it is believed that the enhanced reception/transmission of radio frequency signals occurs through phase diversity coupling with the wire, cable, or pipe that induces bifilar modes within the wire, cable, or pipe.

Particular implementations of an omnidirectional antenna 2, may include only two electrically decoupled loops (wire loop 4 and ferrite rod loop 6) oriented substantially in the same plane and driven 90 degrees out of phase by the hybrid network 20. The ability of the hybrid network 20 to drive the only two decoupled loops 90 degrees out of phase may be controlled by a phase shifting circuit contained within the hybrid network 20. The structure and components of the phase shifting circuit depend upon at least two design factors: 1) the impedance characteristics of the entire hybrid network 20/wire loop 4/ferrite rod loop 6 combination and 2) the frequency of operation of the omnidirectional antenna 2.

For the exemplary purposes of this disclosure, a sample design procedure for determining the characteristics of particular implementations of a hybrid network 20, wire loop 4, and ferrite rod loop 6 follows.

Toroid resistor 30 is impedance matched to the impedance desired at the input 40; for example, for an implementation in which the input impedance is 50 ohms, the value of toroid resistor 30 will also be 50 ohms. Once the value of resistor 30 is determined, the rest of the design values of the components in the system can be evaluated.

The inductance value of either winding of the toroid 28 is represented by:

$$L = \frac{R_{30}}{2\pi f} \tag{1}$$

where L is the inductance of the winding in Henries, $R_{30}$ is the resistance of the toroid resistor 30, and f is the desired antenna frequency in Hertz (ex. 470,000 Hz).

The sum of the values of the toroid capacitors 42 and 44 is represented by:

$$C = \frac{1}{2\pi f R_{30}} \tag{2}$$

where C is the total capacitance of toroid capacitors 42 and 44 in Farads, f is the desired antenna frequency in Hertz, and $R_{30}$ is the resistance of the toroid resistor 30. In some implementations, the total capacitance may be divided equally between the toroid capacitors 42 and 44; in others, the capacitance may be divided unequally or one of the toroid capacitors may have zero capacitance.

The bandwidth of the wire loop 4 and the ferrite rod loop 6 are adjusted by first measuring the impedance ($R_{loop}$+ $jXL_{loop}$) of each loop alone. For the wire loop 4, the bandwidth (in particular implementations, −3 dB) is represented by:

$$BW = \frac{2(R_{loop} + R_{36})}{fX_{loop}} \tag{3}$$

where BW is the bandwidth of the wire loop 4, $R_{100}$, is the resistance of the wire loop 4 or the ferrite rod loop 6, $R_{36}$ is the resistance of the bandwidth resistor 36, f is the desired antenna frequency in Hertz, and $X_{loop}$ is the reactance of the wire loop 4 or the ferrite rod loop 6.

The ratio of the number of turns on the two windings of each of the first and second balun core matching transformers 24, 26 is used to transform the series impedances of the combinations of the wire loop 4 and ferrite rod loop 6, their corresponding first and second series tuning capacitor assemblies 32, 34, and the corresponding bandwidth resistors 36, 38. The transformation is used to match each loop and its corresponding components with the resistance value of the toroid resistor 30. The first and second balun core matching transformers 24, 26 are then used to couple the wire loop 4 and the ferrite rod loop 6 with the toroid 28 (sometimes also called a hybrid network in some implementations). The turns ratio (loop winding to toroid winding) of the first and second balun core matching transformers 24, 26 is 2:9.

Once a particular implementation of a hybrid network 20 has been assembled using the above design procedures, fine physical alignment and adjustment of electrical parameters of the only two decoupled loops must be performed to ensure proper omnidirectional pattern, bandwidth, and tuning as outlined later in this document.

The hybrid network 20 also has a quadrature splitting/combining circuit that enables the generation of an omniazimuthal magnetic field pattern. The omniazimuthal magnetic field is oriented in the horizontal plane because while the omnidirectional antenna is in use, for example, strapped to the wearer's back in a mine tunnel, it is operated with the plane formed by the wire loop 4 oriented substantially vertically, while the long axis of the ferrite rod loop 6 is substantially horizontal. The magnetic fields above and below the omnidirectional antenna 2 are elliptically polarized, which means that to utilize two omnidirectional antennas for communication where one antenna is substantially above or below the other, one of the omnidirectional antennas must be inverted or the leads of either the only two decoupled loops one of the antennas must be temporarily exchanged. When the magnetic fields are viewed from a point directly above the omnidirectional antenna 2, the fields will appear to be circularly polarized. When viewed from any other angle from horizontal, the magnetic fields will appear elliptically polarized.

Without being bound by any theory, the quadrature splitting/combining circuit permits received 90 degree out-of-phase signals from the only two decoupled loops to be combined and sent to a radio coupled to the omnidirectional antenna 2. In addition, the quadrature splitting/combining circuit allows a signal coming from the radio to be divided so that the phase shifting circuit can shift the divided signal 90 degrees out of phase to allow transmission of an omniazimuthal signal. Relevant teachings regarding the structures and operation of quadrature splitting/combining circuits may be found in U.S. Pat. No. 6,194,980 to Thon, entitled "Quadrature hybrid RF combining system," issued Feb. 27, 2001, the disclosure of which is hereby incorporated by reference herein.

The electrical characteristics of the only two decoupled loops and the hybrid network 20 may include clockwise rotation of the magnetic field pattern once per cycle. In addition, the hybrid network 20 may allow each of the only two decoupled loops to handle only half of the radio power and allow each of the only two decoupled loops to maintain substantially constant bandwidth for any input impedance. Because of this, while particular implementations of an omnidirectional antenna 2 may include a 50 ohm input impedance, the same implementations may receive many other input impedances without requiring substantial modification. Because the only two decoupled loops are decoupled, if either or both of them are significantly or severely detuned through laying the antenna down on a metal plate, for example, the input impedance will remain substantially constant. This feature may allow implementations of omnidirectional antennas 2, 70 to exhibit redundancy features, where either loop can be used for transmission/reception if the other loop is damaged or detuned during a mine accident or emergency.

While in the particular implementations of an omnidirectional antenna 2 illustrated in this document, a single wire loop 2 and a single ferrite rod loop 4 are illustrated, other particular implementations may include two wire loops and two ferrite rod loops oriented substantially orthogonally. Such a combination may be encased in a cubic container and allow for sending and receiving of radio signals in both vertically and horizontally aligned omniazimuthal magnetic fields. Also, implementations of omnidirectional antennas with substantially square wire loops and with ferrite rods with rectangular cross sections may be constructed using the teachings disclosed in this document. FIGS. 4 and 5 illustrate an implementation of such an omnidirectional antenna. For square implementations, the design and adjustment procedures are the same as for round implementations, but the part values and turn ratios differ. Those of ordinary skill in the art will readily be able to select turn ratios and part values using the disclosure in this document. In some implementations, square omnidirectional antennas may exhibit better performance and have a thinner and smaller form factor.

Use

Figure 7:
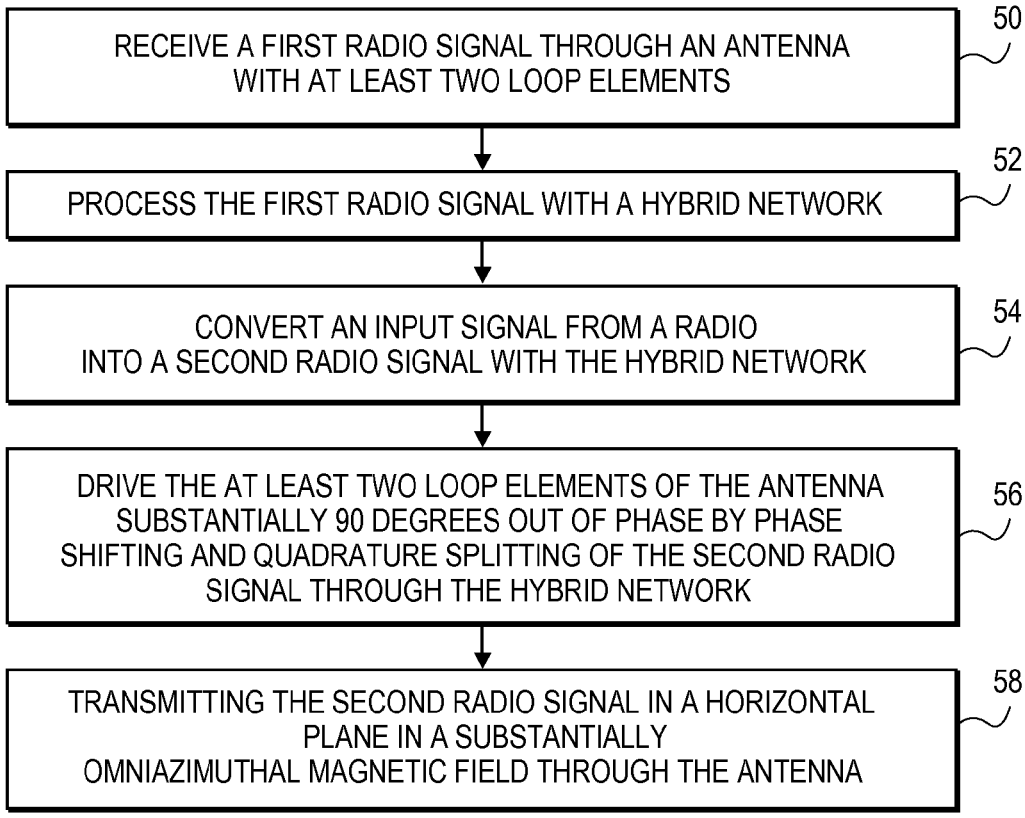
FIG. 7 is a flow diagram of an implementation of a method of radio communication.

Referring to FIG. 7, implementations of an omnidirectional antenna 2 may utilize a method of radio frequency communication that includes sending and receiving steps. The method may include the steps of receiving a first radio signal through the antenna that includes at least two loop elements (step 50, a wire loop 4 and a ferrite rod loop 6, for example) and processing the first radio signal with a hybrid network 20 (step 52). The method may also include the steps of converting an input signal from a radio into a second radio signal with the hybrid network 20 (step 54) and driving the at least two loop elements of the antenna substantially 90 degrees out of phase by phase shifting and quadrature splitting/combining of the second radio signal through the hybrid network 20 (step 56). The method may also include the steps of transmitting the second radio signal in a horizontal plane in a substantially omniazimuthal magnetic field through the antenna (step 58).

A step of increasing the bandwidth of the at least two loop elements through coupling a resistor with the at least two loop elements may be utilized by particular implementations of an omnidirectional antenna 2. In addition, the steps of transmitting the second radio signal (step 58) and receiving the first radio signal (step 50) may take place while the at least two loop elements are rotated 360 degree relative to the axis of a tunnel. Also, implementations of an omnidirectional antenna 47 that include hooks 46 may utilize the steps of transmitting the second radio signal and receiving the first radio signal by further extending the signals by coupling the antenna 47 to a wire or pipe 48 in a tunnel through at least one hook 46 coupled to the antenna 47.

Figure 6:
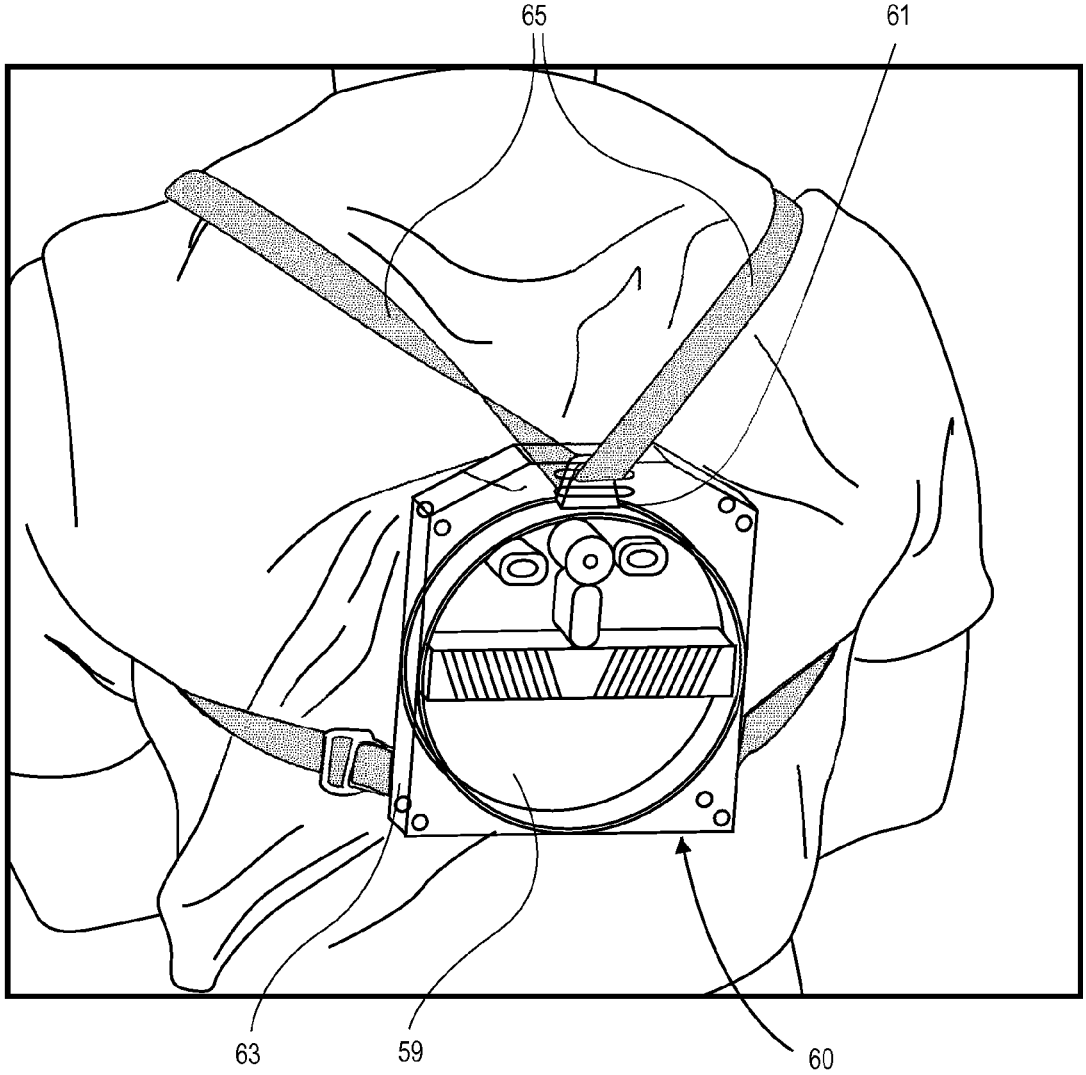
FIG. 6 is a perspective view of an implementation of an omnidirectional antenna strapped to a wearer's back.

The foregoing methods illustrate how implementations of omnidirectional antennas may be particularly useful in mining and other subterranean applications. In these environments, the need for radio communication both within a tunnel, tunnel to tunnel, and with the surface is great, and the ability of a radio signal to be both received and sent between radio units that differ significantly in relative physical orientation is key. Use of omnidirectional antennas allow signals to be sent and received no matter the orientation of the sender's or receiver's radio antennas. In addition, the ability of such an omnidirectional antenna to be wearable on a user's back and of relatively small size is an important consideration. Referring to FIG. 6, a particular implementation of an omnidirectional antenna 60 is illustrated being worn on the back of a user. Straps 65 have been inserted in slots 61 in the top of the mounting board 59 and around posts 63 coupled with the mounting board 59. The straps 65 may also be adjustable in length to allow for differences in wearer size and proportions. Given the relative flatness of this implementation and its small size, a user like a miner could carry such an omnidirectional antenna 60 down into a mine and couple it to a conventional radio and improve his or her ability to simultaneously both send and receive radio signals with individuals located within the same tunnel, adjacent tunnels, or the surface.

In particular, because of the omnidirectional nature of the antenna, implementations of omnidirectional antennas 2, 70 may be able to receive a radio signal at any point along a 360 degree rotation relative to the axis of a tunnel in which such antennas are being used. This feature of the omnidirection antennas 2, 70, means that the wearer can be in any orientation in the tunnel while still able to receive a radio signal without significant quality degradation.

Manufacture

Figure 8:
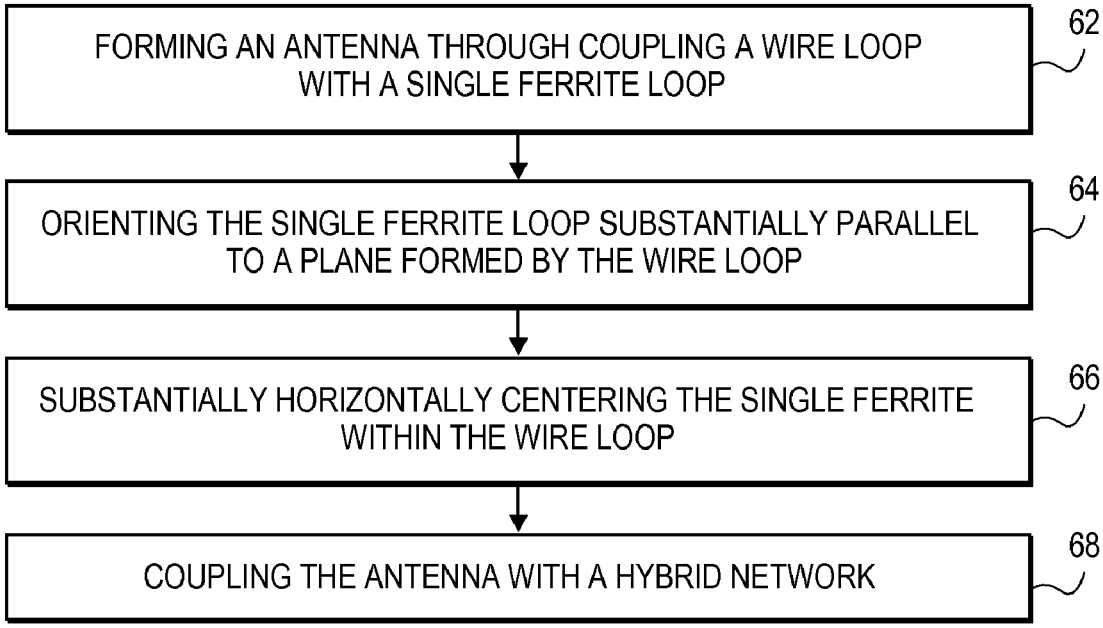
FIG. 8 is a flow diagram of an implementation of a method of forming an omnidirectional antenna system.

Referring to FIG. 8, implementations of omnidirectional antennas may be manufactured through use of a method of constructing an omnidirectional antenna system. The method may include the steps of forming an antenna through coupling a wire loop 4 with a single ferrite loop 6 (step 62), orienting the single ferrite loop 6 substantially parallel to a plane formed by the wire loop 4 (step 64) and substantially centering the single ferrite loop 6 within the wire loop 4 (step 66). Depending upon the particular implementation of an omnidirectional antenna being formed, the step 66 includes both centering the single ferrite loop 6 relative to the wire loop 4 within the wire loop 4 and centering the ends of the single ferrite loop 6 relative to the wire loop 4 (whether or not the single ferrite loop 6 is located within the wire loop 4 or not). The method may also include the step of coupling the omnidirectional antenna with a hybrid network 20 (step 68). The method may further include the steps of increasing the bandwidth of the antenna system through coupling at least one resistor with at least one of the wire loop 4 and the ferrite loop 6.

The following examples of processes for manufacturing the various components of an omnidirectional antenna system are for the exemplary purposes of this disclosure. Those of ordinary skill in the art will be able to readily construct various implementations of omnidirectional antenna systems using the principles disclosed in this document.

Ferrite rod loops like the ferrite rod loops 6, 74 disclosed in this document may be formed by taking a ferrite rod and covering it along a majority of its length with tape to protect a user from any sharp edges (particularly if the rod is rectangularly shaped) and to protect the rod during ordinary use. Duct tape and/or electrical tape may be used as the coating material. The ends of the ferrite rod, however, will not be coated with tape to allow the rod to be coupled with mounts that hold the rod to the mounting board 18, to which a majority of the components of the hybrid network 20 have already been coupled.

After the ferrite rod has been prepared, the plurality of windings 8 can then be added by first finding the exact center of the rod. Two sets of windings can then be added along the majority of the rod at a portion on each side of center. During the winding process (which may be either clockwise or counter-clockwise depending upon the implementation), two different sized wires may be wound around the rod, one wire used for spacing the turns of the wire being used to form the antenna. The wire used for spacing may be either larger or smaller in diameter, depending upon the desired degree of spacing between the wire turns. The pattern and angle of the turns should resemble that shown in FIGS. 1 and 4, and each of the portions of the turns on each side of center should be angled in a mirrored fashion with respect to the turns on the other side of the rod. For the exemplary purposes of this disclosure, when the turns all have been added, the final inductance of the plurality of windings 8 and the ferrite rod loop 74 may be approximately 70 pH.

After the ferrite rod loop 6, 74 has been formed, it may be coupled to the mounting board 18 through plastic inserts and epoxy. Thereafter, an SMA coaxial connector may be added along with a coaxial wire connection to the hybrid network 20. Once added, the wire loop 6, 72 may be constructed by winding turns of wire counterclockwise around a loop frame (thirteen turns for a wire loop 72). The loop frame may be any closed shape desired. As illustrated in FIGS. 2 and 5, the turns may be angled relative to the plane formed by the loop frame. After the turns have been placed on the loop frame, they may be held in position using electrical tape wound around the loop frame. For the exemplary purposes of this disclosure, the inductance of a resulting implementation like the wire loop 72 may be approximately 60 pH when the loop is held away from metal objects.

Once the ferrite rod loop 6, 74 has been securely fastened and all remaining connections have been formed and soldered in place, the omnidirectional antenna 2, 70 is ready for tuning and testing procedures that verify and set its electrical behavior.

The first tuning test may be an antenna isolation test to ensure that the ferrite rod loop 6, 74 and wire loop 6, 72 are not coupled electrically or magnetically. This may be accomplished by coupling the coaxial input of the antenna system with the 50 ohm coaxial RF output of an EMC analyzer (such as an HP E7401A, set to output at 470 kHz), coupling the 50 ohm coaxial RF input of the analyzer at the first balun core matching transformer 24, and connecting a shield wire to the toroid resistor 30 to ground the system. After positioning the antenna about 2 feet away from metal objects or the floor, the tilt of the ferrite bar is adjusted until a minimum received signal displays on the analyzer, indicating that the ferrite rod loop 6, 74 is substantially electrically and/or magnetically decoupled from the wire loop 4, 72.

After ensuring the decoupling of the ferrite rod loop 6, 74 and the wire loop 4, 72, the next test may be to fix the alignment between the wire loop 4, 72 and the ferrite rod loop 6, 74 which determines the resonant characteristics of the omnidirectional antenna. The alignment ensures that: 1) each of the loops is properly tuned and 2) the wire loop 4 and the ferrite rod loop 6 are substantially orthogonal to each other.

For the exemplary purposes of this disclosure, the following method may be used to tune each of the wire loop 4 and ferrite rod loops 6. Referring to FIG. 3, tuning may be accomplished by attaching a 470 kHz frequency, 50 ohm source (such as the HP E7401A EMC analyzer) to the 50 ohm input 40 of either the wire loop 4 or the ferrite rod loop 6. For the exemplary purposes of this disclosure, the wire loop 4 may be tuned first. A suitable single loop antenna (such as a Fairchild ALP-10 loop antenna) may be connected to an Alternating Current Volt Meter (ACVM) or the input of the analyzer and then placed 2 meters or other convenient distance away from the omnidirectional antenna to receive the signal from the particular loop being tuned. With the loop antenna oriented coaxially (like two wheels on the same axle), the signal received by the single loop antenna visible on the ACVM is adjusted to peak (or to maximum received signal if an analyzer is used) by using the ceramic trimming elements to change the capacitance of the first and second tuning capacitor assemblies 32, 34. Additional capacitors may need to be added to the first and second tuning capacitor assemblies 32, 34 to provide added capacitance. The same steps are then performed to tune the ferrite rod loop 6, 74, with the loop antenna oriented coaxially with the ferrite rod 10.

After the tuning of the ferrite rod 10 and the wire loop 4, 72 (and a retest of the wire loop 4, 72, if desired), the bandwidth of wire loop 4, 72 and the ferrite rod loop 6, 74 may be measured. This may be accomplished by coupling an analyzer in the same configuration used for the tuning procedure and moving the marker on the analyzer over −3 dB to the left and the right of the 470 kHz tuning frequency. The frequencies received at each −3 dB point are then added together to determine the total bandwidth of each loop, which may be, particularly for implementations including ferrite rod loops 74 and wire loops 72, approximately 20 kHz for each loop.

After finalizing the tuning of the loops and the positioning of all the components, the omnidirectional antenna 2, 70 can now be put through various tests to verify its electrical characteristics. The first of these is an omnidirectional tuning test, which is performed by connecting the omnidirectional antenna to an analyzer in the same configuration used for the bandwidth measurement procedure. The antenna is then rotated slowly while being held up vertically while the amount of variation of the received signal strength at the loop antenna is observed on the analyzer. If no greater variation than approximately 2 dB is observed, the antenna passes the omnidirectionality test; if the test fails, the antenna probably has various wiring problems.

To verify the gain of the new omnidirectional antenna 2, 70, a known good omnidirectional antenna is setup at the same distance from the loop antenna as the new antenna. The known good omnidirectional antenna may then be rotated on its vertical axis to observe the average received signal strength. If the new omnidirectional antenna 2, 70 exhibits substantially the same averaged received signal strength as the known good antenna (below about 1 dB on the average), the new antenna passes the test.

The last test performed may be a phasing test. To perform the phasing test, the new omnidirectional antenna 2, 70 may be coupled with the analyzer in the same configuration as was used for the bandwidth test while the loop antenna is replaced by the known good omnidirectional antenna oriented vertically. The new omnidirectional antenna 2, 70 is then rotated along its vertical axis while the received signal strength is observed on the analyzer. If there is little variation with no significant null signal areas, the new omnidirectional antenna is properly configured and tuned. Otherwise, either of the loops may be wired backward and require a swap of the leads of one of the loops and subsequent retesting. Once testing has been completed, the screws on the mounting board can be secured with silicone and a cover can be placed over the wire loop, 4, 72 and ferrite rod loop 6, 74 to protect them while in use.

It will be understood that implementations are not limited to the specific components disclosed herein, as virtually any components consistent with the intended operation of a method and/or system implementation for an omnidirectional antenna may be utilized. Accordingly, for example, although particular wire loops, ferrite rods, resistors, capacitors, or hooks may be disclosed, such components may comprise any shape, size, style, type, model, version, class, grade, measurement, concentration, material, weight, quantity, and/or the like consistent with the intended operation of a method and/or system implementation for an omnidirectional antenna may be used.

In places where the description above refers to particular implementations of omnidirectional antennas, it should be readily apparent that a number of modifications may be made without departing from the spirit thereof and that these implementations may be applied to other omnidirectional antennas. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. An omnidirectional antenna system comprising:

an antenna comprising a wire loop and a single ferrite rod loop, the single ferrite rod loop oriented substantially parallel to a plane formed by the wire loop;

wherein the single ferrite rod loop comprises a plurality of windings and a ferrite rod comprising a length and two ends; and a 90-degree hybrid network coupled to each of the wire loop and the single ferrite rod loop;

wherein the wire loop and the single ferrite rod loop are substantially electrically isolated from each other through the hybrid network.

2. The omnidirectional antenna system of claim 1, further comprising at least one resistor coupled to at least one of the wire loop and the ferrite rod loop.

3. The omnidirectional antenna system of claim 1, wherein the wire loop is substantially circular or substantially square.

4. The omnidirectional antenna system of claim 1, wherein the ferrite rod comprises one of a substantially circular cross-section and a substantially rectangular cross-section.

5. The omnidirectional antenna system of claim 1, further comprising a transmit amplifier coupled to the hybrid network.

6. A method of radio frequency communication comprising:

receiving a first radio signal through an antenna comprising at least two loop elements with orthogonal magnetic axes, the first radio signal being received through one or more of the at least two loop elements;

combining the first radio signal from the one or more of the at least two loop elements using a hybrid network; and transmitting a second radio signal in a horizontal plane in a substantially omnidirectional magnetic field through the antenna by driving the at least two loop elements of the antenna substantially 90 degrees out of phase by phase shifting and quadrature splitting/combining of the second radio signal through the hybrid network.

7. The method of claim 6, further comprising increasing the bandwidth of the at least two loop elements through coupling a resistor with the at least two loop elements.

8. The method of claim 6, wherein the steps of transmitting the second radio signal and receiving the first radio signal take place while rotating the at least two loop elements 360 degrees relative to the axis of a tunnel.

9. The method of claim 6, wherein the steps of receiving a first radio signal and transmitting the second radio signal in the horizontal plane further comprise the step of extending the reception of the first radio signal and the transmission of the second radio signal through coupling the antenna to a wire or pipe in a tunnel.

* * * * *